United States Patent [19]

Axgärde et al.

[11] 4,038,789

[45] Aug. 2, 1977

[54] ADJUSTABLE MANHOLE FRAME ASSEMBLY

[75] Inventors: Gunnar Albert Axgärde, Stockholm; Bengt Borje Axelsson, Jonkoping; Alf Klingwall, Stockholm, all of Sweden

[73] Assignee: Parca-Norrahammar AB, Sweden

[21] Appl. No.: 559,559

[22] Filed: Mar. 18, 1975

[30] Foreign Application Priority Data

Mar. 19, 1974 Sweden ..... 7403646

[51] Int. Cl.[2] ..... E02D 29/14

[52] U.S. Cl. ..... 52/20; 52/19; 403/62; 403/362; 285/404; 403/109

[58] Field of Search ..... 4/146; 52/19, 20, 21; 210/163, 164, 165, 166; 248/159, 354 R, 354 S, 354 P, 411, 413; 285/42, 302, 404; 403/109, 362

[56] References Cited

U.S. PATENT DOCUMENTS

| | | | |
|---|---|---|---|
| 638,692 | 12/1899 | Banwell | 210/164 |
| 640,304 | 1/1900 | Lowe | 403/62 |
| 1,431,612 | 10/1922 | Wittner | 403/362 |
| 2,749,999 | 6/1956 | Schmid | 285/404 |

*Primary Examiner*—Price C. Faw, Jr.
*Assistant Examiner*—Robert C. Farber

[57] ABSTRACT

An adjustable manhole frame assembly for underground conduits, catch basins, or the like, in which telescoped upper and lower frames include screw fasteners engaging in vertically-angulated slots for adjusting the frames axially and angularly to orient the top frame and its cover in relation to an upper surface such as the running surface of a street, or the like.

5 Claims, 6 Drawing Figures

ADJUSTABLE MANHOLE FRAME ASSEMBLY

FIELD OF THE INVENTION

The present invention relates to manhole cover arrangements for wells, pits, sewer openings, and the like.

BACKGROUND OF THE INVENTION

More particularly, the manhole cover assembly of the present invention concerns a top frame adapted to carry a cover or lid and a bottom frame adapted to be supported on a base or foundation around a well opening, etc., and in which the top frame is provided with portion telescopically received in the bottom frame. The arrangement includes one or more locking means for securing the frames together in an adjusted position with respect to each other and the upper surface in which the manhole cover assembly is disposed.

In concrete manholes located in streets, pavements and other frequently trafficked areas, it is necessary that the cover be in an essentially flush condition with respect to the surrounding street or pavement surface, which requires the top portions of the manhole cover assembly to be adapted to the surface after the surface has been repaired or resurfaced.

It has been previously proposed to form the top frame of a manhole assembly as a lock ring or frame fitted in a recess in a bottom frame which is built-up in order to compensate for a rise in the level of the street or pavement surface which has been resurfaced. Such single rings or frames, however, make it necessary to adapt the surfacing material (or alternatively excavation of the material) around the manhole to compensate or orient the street surface with respect to the single ring or frame, or vice versa, which is not an acceptable economical practice.

It is also known to use telescopic top and bottom frames without using lock members to that the frames can be fixed with respect to each other. However, the plural frame arrangements known in the prior art, have drawbacks which improperly expose the upper frame to street servicing implements, such as snowplows or the like.

SUMMARY AND OBJECTS OF THE INVENTION

According to the invention, an improved manhole cover assembly comprises mutually telescoped upper and lower frames in which the lower frame has a counterpressure surface extending vertically at an angle relative to an inserted portion of the top frame, and adjustable members such as screws, or the like, act on the counterpressure surface at different levels in an axial direction with respect to the bottom frame, whereby the frames can be lockingly fixed with respect to each other and in which angular relation relative to the longitudinal axis of the frames, i.e. and to the running surface of the street, or the like, can be compensated for.

The present invention provides an arrangement in which the telescopically related top and bottom frames include relatively simple adjusting means comprising adjusting screws and in which the angular relation or inclination of the street surface, or the like, can be readily compenated for.

The present invention includes frames which can be constructed through the use of a minimum amount of material and, thus, comprise a relatively low weight lending the frames to be cast from spherical cast iron which affords a light and strong structure.

The manhole cover assembly, according to the invention, is characterized by a counterpressure surface which extends at an angle ($\alpha$) to the surrounding inner surface of a bottom frame, and protruding members on the top frame cooperate with the counterpressure surface at different levels in a vertical direction so that the protruding members are lockable at different degrees of extension to telescopically adjust the top and bottom frame with respect to each other.

These, together with other objects and advantages of the invention, will become apparent from the following description of exemplary embodiments, when taken in conjunction with the drawings forming a part thereof, in which:

DESCRIPTION OF THE DRAWINGS

FIG. 4 is a view similar to FIG. 1*b* showing the top and bottom frames of the manhole cover assembly in a relatively inclined position compensating for the slope of a street, or the like.

DESCRIPTION OF THE PREFERRED EMBODIMENTS

Figure 1B:
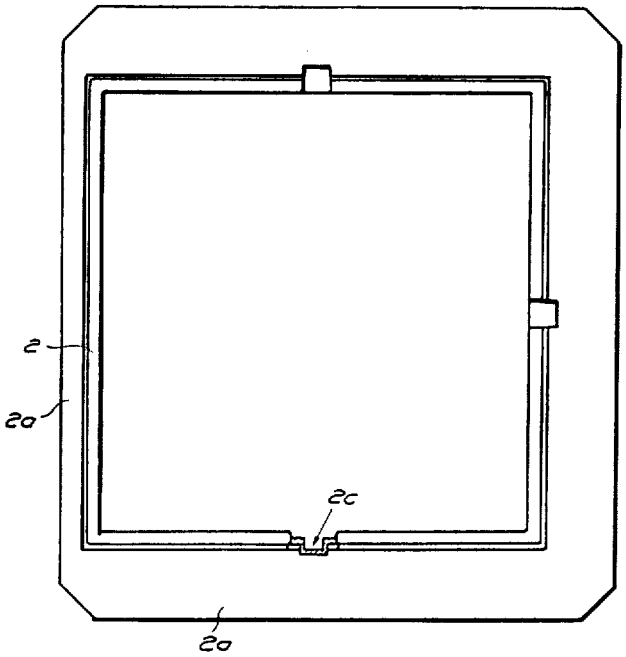
FIG. 1*b* is a reduced, top plan view of the bottom frame used in FIG. 1*a* with a portion broken away and shown in section.
Figure 1A:
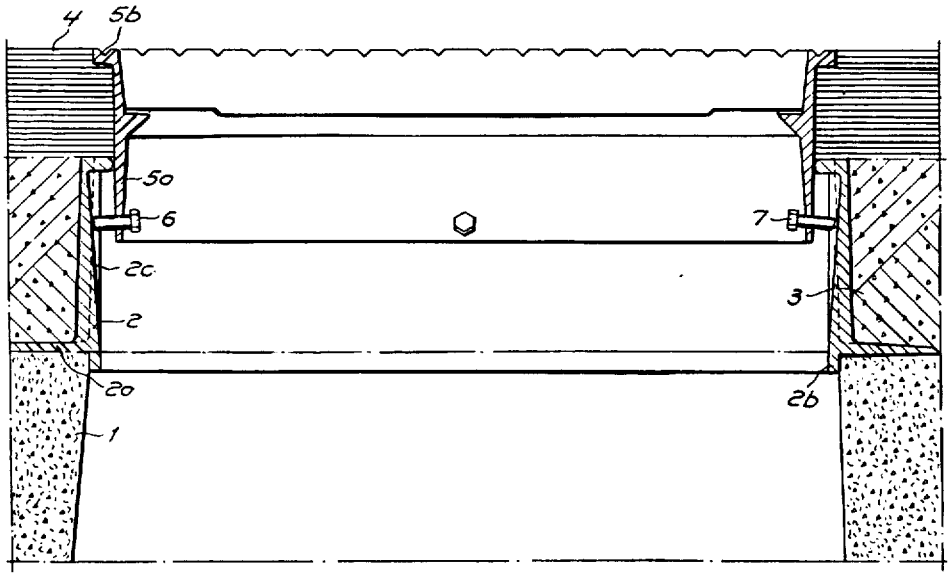
FIG. 1*a* is a fragmentary vertical section of a concrete manhole opening incorporating the adjustable manhole cover assembly of the invention.

In FIG. 1*a* there is shown a lower cast base or foundation providing the throat or opening of a manhole. Laid on the base 1, as is conventional, is a bottom frame 2 having at its lower end a latteral, outwardly-projecting flange 2*a* which is surrounded by a layer of sand, cinders, or the like. On the layer of sand or cinders, one or more covering layers of asphalt or surfacing material 4 is applied. The bottom frame 2 includes a depending bottom edge portion 2*b* which abuts and cooperates with the adjacent peripheral face of the upper end of the concrete base 1 so that the bottom frame 2 will not be laterally displaced.

A top frame projects above the bottom frame and is provided with a depending peripheral portion 5*a* which telescopes into the bottom frame, and the top frame includes a top flange 5*b*, projecting outwardly, and overlying the adjacent layers of the surfacing material 4. The top frame carries a manhole cover or lid, in the usual manner, and the portion 5*a* is of sufficient length or depth to provide adjustable extension with respect to the bottom frame. Thus, the total height of the two frames may be adjusted to accommodate for the actual level of the surface of the street, pavement, etc. where the manhole assembly is located.

It will be observed that the manhole assembly can be initially constructed so that the top frame is preferably located in a half-extended position so that the mutual height of the frames can be adjusted upwardly or downwardly as is required at a later date, i.e. during resurfacing of the pavement, etc.

The two frames are provided with locking means in the form of adjustable members, which are constituted by screws 6 and 7, extending through suitably threaded apertures in portion 5*a* of the top frame and which are accessible from the inside of the top frame so that they, when tightened, can be urged into contact with counterpressure surfaces on the inner face of the bottom frame 2. The counterpressure surfaces for the respective lock screws 6 and 7 are vertically inclined in relation to the inner surface of the bottom frame (whether the frames are angular, or rectangular), and in view of this angularity, adjustment of the screws inwardly or outwardly; see FIGS. 3*a* and 3*b*, will permit different positions of engagement between the terminal end of the screws and the vertically angulated counterpressure surfaces. For example, if the top frame of FIG. 3*a* is raised, the inner end of the screw 7 will no longer abut the counterpressure surface 2*c*, and thus upon running the screw 7 inwardly a sufficient distance, the clearance that results due to raising the top frame will be taken up and the frames will be held in a vertically adjusted position. Of course, the screw 7 can be run in sufficiently to provide a frictional bind so that the top frame cannot be adjusted with respect to the bottom frame unless the adjusting screws are backed off.

Because of the lock means, the frames constitute a rigid unit which will function properly in spite of traffic vibrations, for example, and thus damage around the manhole assembly is substantially minimized.

Figure 2:
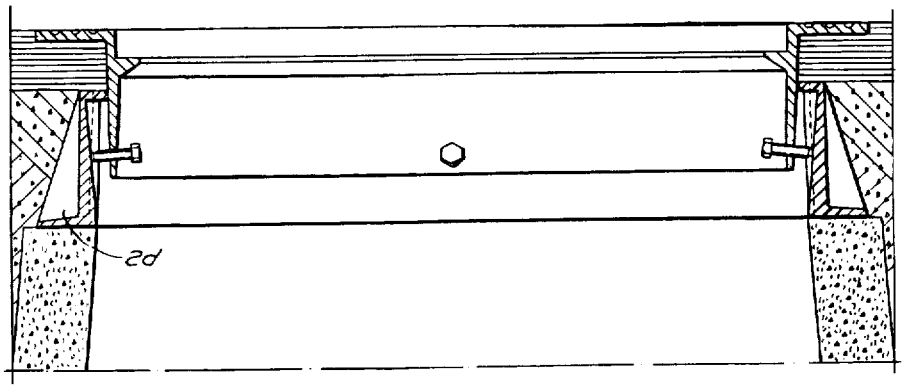
FIG. 2 is a vertical sectional view showing another embodiment of a concrete manhole having top and bottom frames.

In the embodiment of FIGS. 1 and 2, the counterpressure surfaces of the respective lock means are constituted by outwardly inclined surfaces 2*c* at the innermost portion or bottom of vertically extending grooves formed in the face of the bottom frame. The walls of the grooves serve as stop surfaces against relative rotation in the event cylindrical frames are utilized.

FIGS. 1*a* and 1*b* illustrate a manhole cover assembly comprising square frames, and referring to FIG. 1*b*, the bottom frame is provided with the inclined surfaces 2*c* in three of its walls. An inclined surface is omitted from the fourth wall so that this wall can be made relatively thinner or narrower, and thus accommodating the wall for close abuttment with curb stones, for example, and the flange 2*a* of the fourth wall can also be made narrower. If there is no requirement for close abuttment to the curb stones on the fourth side, this side can also be provided with an inclined surface 2*c*, just as the other walls, or the walls can incorporate a plurality of inclined surfaces. In FIG. 2 there is illustrated an assembly of cooperating frames which have a circular cross-section. In this instance, the upper peripheral flange of the top frame will extend outwardly a greater degree than that shown in FIG. 1*a*, for example. Indicated at 2*d* in both FIGS. 2 and 3*a*, are vertically extending ribs or flanges disposed behind the counterpressure surface 2*c*.

Figure 3B:
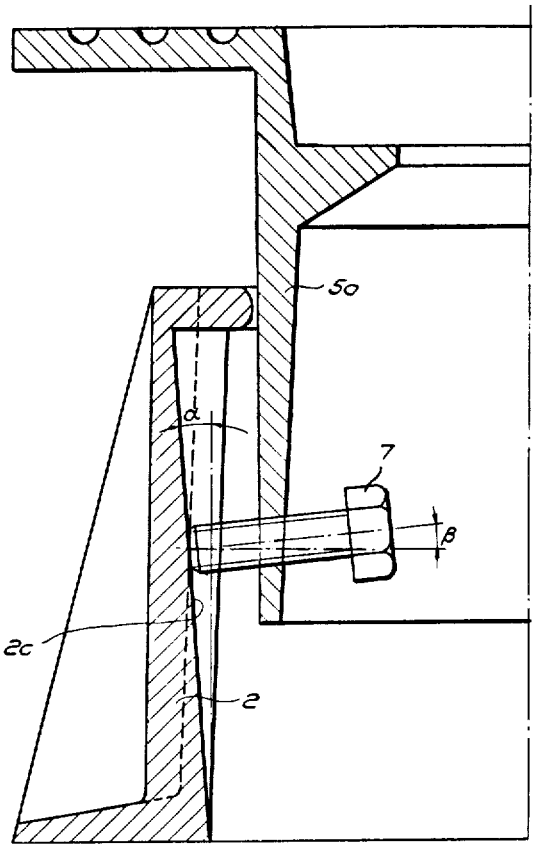
FIG. 3*b* is a fragmentary, enlarged vertical section, similar to FIG. 3*a* and showing another adjusted position of the parts.
Figure 3A:
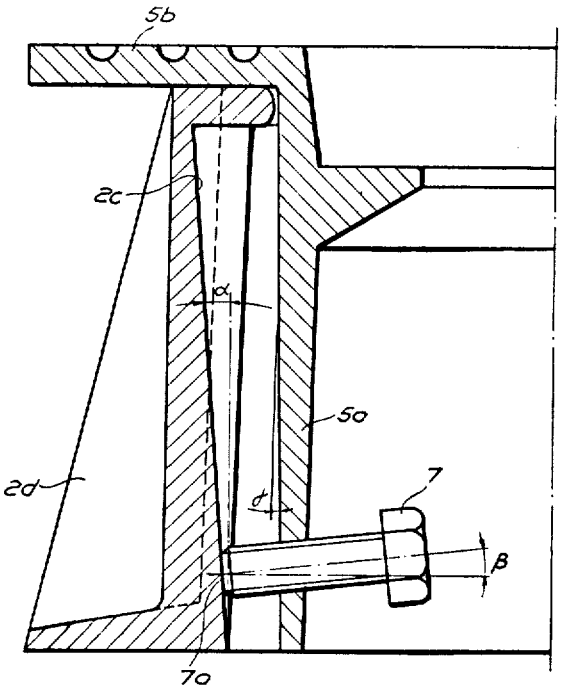
FIG. 3*a* is a fragmentary, enlarged sectional view of a portion of the adjustable manhole cover assembly of the invention showing one position of adjustment.
Figure 4:
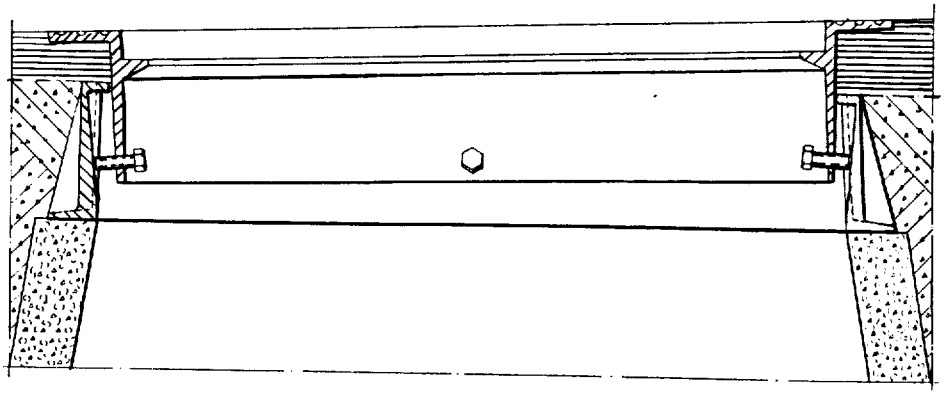

FIGS. 3*a* and 3*b* show the construction in greater detail and particularly the shape of the inclined counterpressure surface 2*c* and the manner in which the terminal end of the screw 7 is applied to the counterpressure surface. The surface 2*c* is inclined at an inclination of $\alpha$ from a vertical plane which in the exemplary embodiment coincides with the inner surface of the bottom frame, this angle being from about 3° to 10°, and a 5° inclination has proved to be particularly satisfactory.

The lock screw 7 projects axially at an angle or inclination with respect to a horizontal plane so that the angle $\beta$ substantially corresponds to the inclination $\alpha$, i.e. in the preferred embodiment $\alpha$ equals 5° and $\beta$ also equals 5°. The lock screw provides a plain end surface, and owing to the inclinations or angles chosen, the end surface of the screw 7 will generally be disposed parallel to the inclined surface 2*c* when the screw is tightened.

The free end of the lock screw 7 comprises a protruding member integral with portion 5*a* of the inner frame and could comprise other types of pressure-compensating means.

Referring to FIGS. 3*a* and 3*b*, in FIG. 3*a* the inner or upper frame is in a fully collapsed condition, while in FIG. 3*b*, the frames are partially extended with respect to each other wherein the top or inner frame is raised vertically, and thus the screw 7 is moved in towards the counterpressure surface 2*c*.

In accordance with the invention, the suitable clearance provided between the top and bottom frames to that they can be inclined (horizontally) with respect to each other. The outside portion 5*a* is somewhat inclined, and the clearance between the frames, when they are in the completely inserted position, ranges from 5 to 15 mm. and the wall length of the overlapped frame is approximately 0.75 mm. and the height of the top and bottom frame, respectively is approximately 0.2 mm.

The invention is not limited to the exemplary embodiments shown, but the counterpressure surfaces may include holes for accommodating the terminal ends of the lock screws and such screws may have semi-spherical ends and accordingly, such recesses would be complimentary. Additionally, if frames are rectangular, wedges could be utilized to lock the frames in adjusted positions with respect to each other. The top frame could incorporate other types of depending flanges, the equivalent of the flange 5*a*, for example, step-like constructions could be utilized with complimentary inverted steps on the lowermost frame, for example.

What is claimed is:

1. A manhole assembly comprising a top frame for carrying a cover; a bottom frame supported on a base for the manhole, a portion of said top frame being telescoped in the bottom frame; a plurality of lock means for locking the frames in a mutually-adjusted position, said lock means extending between the portion of the top frame inserted in the bottom frame and including laterally projecting screws terminating outside of the portion telescoped in the bottom frame, a bottom frame including counterpressure surfaces confrontingly disposed adjacent the ends of the screws for engagement therewith when the screws are tightened, said counterpressure surfaces extending at a vertical angle with respect to the vertical axis of the bottom frame and converging downwardly, said protruding screws having a plurality of adjusted positions along the angular counterpressure surface positioning the frames at different adjusted levels, the longitudinal axes of said screws being substantially perpendicular to a corresponding counterpressure surface with which it cooperates and the end portion of the screws moving substantially parallel against the counterpressure surface when the screw is tightened.

2. The structure as claimed in claim 1, in which said screws project through threaded apertures in a portion of the top frame, said counterpressure surfaces extending axially over the bottom frame.

3. The structure as claimed in claim 2, in which said counterpressure surfaces are disposed within vertically-extending grooves, the counterpressure surfaces comprising the bottom of said grooves.

4. The structure as claimed in claim 1, in which the counterpressure surfaces have an inclination from a vertical plane from between 3° to 10°, and the screws have an inclination with respect to horizontal plane corresponding to the inclination of the counterpressure surfaces.

5. The structure as claimed in claim 1, in which said top and bottom frames have a clearance therebetween permitting the frames to have relative angular adjusted positions with respect to each other and a horizontal plane.

* * * * *